US009823050B2

(12) United States Patent
Martinez et al.

(10) Patent No.: US 9,823,050 B2
(45) Date of Patent: Nov. 21, 2017

(54) INTEGRATED BODY ARMOR GARMENT

(71) Applicant: Mission Ready Services, Inc., Kelowna (CA)

(72) Inventors: Francisco Martinez, Wellesley, MA (US); Robert Dilalla, Westwood, MA (US); Roxanne Ferreiro, Weston, MA (US); Yolita Nugent, West Roxbury, MA (US)

(73) Assignees: Mission Ready Services, Inc., Kelowna (CA); The United States of America as Represented by the Secretary of the Army, Washington, DC (US)

( * ) Notice: Subject to any disclaimer, the term of this patent is extended or adjusted under 35 U.S.C. 154(b) by 509 days.

(21) Appl. No.: 14/310,251

(22) Filed: Jun. 20, 2014

(65) Prior Publication Data

US 2015/0247705 A1 Sep. 3, 2015

Related U.S. Application Data

(60) Provisional application No. 61/885,074, filed on Oct. 1, 2013.

(51) Int. Cl.
*F41H 1/02* (2006.01)
*A41D 13/015* (2006.01)

(52) U.S. Cl.
CPC ..... *F41H 1/02* (2013.01); *A41D 13/0153* (2013.01)

(58) Field of Classification Search
CPC ..... A41D 13/0518; A41D 13/0506; A41D 13/08; A63B 71/12; F41H 1/02
(Continued)

(56) References Cited

U.S. PATENT DOCUMENTS 1,282,411 A * 10/1918 Golembiowski ..... F41H 1/02 152/196
2,748,391 A * 6/1956 Lewis, Jr. ..... F41H 1/02 2/2.5

(Continued)

FOREIGN PATENT DOCUMENTS

CA 2269527 C 12/2003
CN 201444943 5/2010

(Continued)

OTHER PUBLICATIONS

European Patent Office, Supplemental Search Report, EPO Form 1503, Application No. EP14862834, Aug. 19, 2016, European Patent Office, The Hague, 2 pages.

*Primary Examiner* — Tejash Patel
(74) *Attorney, Agent, or Firm* — Thomas P. O'Connell; O'Connell Law Firm

(57) ABSTRACT

An integrated body armor garment for providing protection to a wearer against ballistic impacts. The garment has a body portion and a ballistic resistant armor system. The body portion can have an outer shell and an underlayer, and the armor system can be embedded within the body portion between the outer shell and the underlayer. The garment can be an upper body garment with a torso portion and left and right arm sleeves and a ballistic-resistant collar, and the armor system can be an upper torso armor system with body armor panels overlapping in a reverse shingle configuration. The armor system can have a plurality of armor panels connected by a resilient cord or other elastic suspension network. The network can be adjustable, as by a cinching of the cord, to permit the body armor panels to be adjusted in relative position.

40 Claims, 9 Drawing Sheets

(58) Field of Classification Search
USPC ..... 2/463, 464, 465, 2.5, 16, 459
See application file for complete search history.

(56) References Cited

U.S. PATENT DOCUMENTS

| | | | | |
|---|---|---|---|---|
| 2,790,973 | A | 5/1957 | Lewis, Jr. et al. | |
| 3,130,414 | A * | 4/1964 | Bailey | F41H 1/02 2/2.5 |
| 3,392,406 | A * | 7/1968 | Pernini | F41H 1/02 2/2.5 |
| 3,973,275 | A * | 8/1976 | Blauer | F41H 1/02 2/2.5 |
| 4,443,506 | A * | 4/1984 | Schmolmann | F41H 1/02 428/102 |
| 4,660,223 | A * | 4/1987 | Fritch | B32B 15/14 2/2.5 |
| 5,771,489 | A * | 6/1998 | Snedeker | F41H 5/0492 2/2.5 |
| 5,797,140 | A | 8/1998 | Davis et al. | |
| 5,974,585 | A | 11/1999 | Bachner, Jr. | |
| 6,026,509 | A * | 2/2000 | Bachner, Jr. | F41H 1/02 2/2.5 |
| 6,305,031 | B1 * | 10/2001 | White | A41D 13/0153 128/882 |
| 6,453,791 | B1 | 9/2002 | Seitzinger | |
| 6,961,958 | B1 | 11/2005 | Seitzinger | |
| 7,093,301 | B1 * | 8/2006 | Moore, Jr. | A41D 13/0518 2/2.5 |
| 7,386,894 | B2 | 6/2008 | Straiton | |
| 7,647,651 | B2 * | 1/2010 | Contant | A41D 13/0512 2/459 |
| 7,757,307 | B2 | 7/2010 | Wong | |
| 7,810,167 | B2 | 10/2010 | Seitzinger et al. | |
| 8,214,929 | B2 * | 7/2012 | Kraemer | A63B 71/12 2/459 |
| 2006/0143763 | A1 | 7/2006 | Dawson et al. | |
| 2007/0136920 | A1 | 6/2007 | Lefebvre et al. | |
| 2009/0151036 | A1 | 6/2009 | Joseph | |
| 2009/0223622 | A1 | 9/2009 | Llano | |
| 2010/0229273 | A1 | 9/2010 | Crye | |
| 2011/0072545 | A1 | 3/2011 | Bennett | |
| 2011/0168003 | A1 | 7/2011 | Kim | |
| 2011/0168320 | A1 | 7/2011 | Llano | |
| 2012/0023641 | A1 | 2/2012 | Shen | |
| 2013/0019365 | A1 | 1/2013 | Howell | |
| 2014/0201878 | A1 | 7/2014 | Ballesteros Casas | |

FOREIGN PATENT DOCUMENTS

| | | |
|---|---|---|
| DE | 29605503 U1 | 9/1996 |
| EP | 0507607 | 10/1992 |
| FR | 2813387 | 3/2002 |
| JP | 5392650 | 1/2014 |
| WO | WO 9213250 | 8/1992 |
| WO | WO 2006/072179 | 7/2006 |
| WO | WO2006092981 | 9/2006 |
| WO | WO 2009/123584 A1 | 10/2009 |
| WO | WO 2010/102351 | 9/2010 |
| WO | WO 2010/108133 | 9/2010 |
| WO | WO 2012/135578 A1 | 10/2012 |

* cited by examiner

INTEGRATED BODY ARMOR GARMENT

STATEMENT AT TO GOVERNMENT RIGHTS

This invention was made with government support under Contract No. W911QY-12-C-0148 awarded by the Natick Contracting Division, U.S. Army Contracting Command-APG. The government has certain rights in the invention.

FIELD OF THE INVENTION

The present invention relates generally to articles of fragment resistant clothing, which may alternatively be referred to as anti-ballistic, ballistic protection, or body armor clothing. Stated more particularly, disclosed herein is an integrated body armor garment with a network of body armor panels that provides protection from ballistic threats while exhibiting maximized areas of protection, comfort, and breathability and while permitting a wide range of motion and, in certain embodiments, automatically self-adjusting placement of the body armor panels.

BACKGROUND OF THE INVENTION

Bullet and fragment resistant body armor vests and garments are standard personal protective equipment for military and law enforcement personnel. Their usage in most cases is mandatory and can be very effective in reducing casualties. Among other things, such bullet and fragment resistant body armor garments seek to protect vital organs and major arteries.

Common materials used for absorbing high kinetic energy projectiles include para-aramid materials from suppliers including E. I. du Pont de Nemours and Company of Wilmington, Del., USA and Teijin Aramid of Arnhem, the Netherlands and Ultra High Molecular Weight Polyethylene (UHMWPE) materials from suppliers including Honeywell International, Inc. of Morristown, N.J., USA (Honeywell) and DSM Dyneema, LLC of Stanley, N.C. One Honeywell product is a flexible ballistic composite made from layers of unidirectional fibers held in place by flexible resins, which is sold under the trademark Spectra Shield™. The fibers are arranged so they cross each other orthogonally, and the fiber and resin layers are sealed between sheets of polyethylene film. The individual fibers, which are produced using a gel-spinning process, are typically bright white polyethylene fibers with high resistance to chemicals, water, and ultraviolet light. They are said to be stronger than steel, forty percent stronger than aramid fiber, and capable of withstanding high-load strain-rate velocities. These and other ballistic materials require multiple layers to be effective against common threats and are usually sequestered in waterproofed panels that are then compartmentalized in sub-layer pockets within a garment.

The resulting multiple layers needed for protection, forty or more plies in some cases, can hinder the range of motion required for adequate bending and stretching. The multiple layers can also lead to comfort challenges and, potentially, shearing within the garment. Many systems are thus bulky and cumbersome. Multiple modular elements are often necessary, and those multiple elements typically require multiple steps for donning and doffing. These further limit the wearer's mobility and hamper performance. Further, the modular ballistic elements can be misaligned, intentionally or unintentionally excluded, and can undesirably shift thereby resulting in exposed body areas and uneven load distribution that can, among other things, contribute to fatigue from thermal, muscular, and skeletal trauma.

A plurality of body armor garment systems and methods have been disclosed by the prior art. However, even with these teachings, body armor garments of the prior art continue to suffer from a number of shortcomings that have prevented significant improvement in fit and comfort. Indeed, many developments have consequently remained merely theoretical in nature.

As a result, it is clear that there remains a need for bullet and fragment resistant garment systems and methods that permit optimized performance, which may be referred to as human or athletic performance, including through greater range of motion and human body performance. It is equally clear that there is a need for such systems and methods where bullet and fragment resistant components can be fully integrated, including to reduce the difficulty of donning and doffing while preventing unintended displacement of the body armor components and evening load distribution thereby reducing fatigue from, for instance, thermal, muscular, and skeletal trauma.

It is recognized that many bullet and fragment resistant body armor systems disclosed by the prior art for military and law enforcement could achieve at least some of their intended purpose if worn properly. However, because their designs require multiple steps for donning and doffing, their use often becomes impractical and leads to improper application and reduced effectiveness. Other constructions can additionally or alternatively present danger and discomfort to the wearer, such as by failing to distribute the substantial weight of body armor evenly on the garment and potentially permitting inadvertent shifting of the modular elements. For example, current military applications that require deltoid protection on the arms use a modular deltoid panel that is separate from the body armor vest. Due to their modularity, the deltoid panels can have reduced effectiveness. For instance, wearers will often eliminate the panels for comfort, or the panels may leave gaps in coverage since they are separate pieces that can shift or may not be sized to stretch to differently sized deltoid muscles. For these and further reasons, it is apparent, at least to the present inventors, that most prior art bullet and fragment resistant body armor systems fail to provide the ease of use and effectiveness necessary for the rigorous and demanding special needs of military and law enforcement users.

A number of body armor apparatuses have sought to protect the user and overcome some of the foregoing issues by further anchoring the system, such as to lower layer garments, underwear, and the wearer's legs or other body parts to prevent shifting and exposure of vital areas. Such systems, even if effective in anchoring the components of the system, unfortunately limit the ease of use and the mobility of the wearer. It will thus be appreciated that the ability to provide a design that is less cumbersome and can be intuitively donned and doffed in a manner similar to any other garment has substantially eluded inventors of the prior art.

In light of the foregoing, it will be appreciated that a fragment and bullet resistant body armor garment that stably retains body armor material while permitting high-level athletic performance would represent a useful advance in the art of body armor, particularly for military and law enforcement personnel.

SUMMARY OF THE INVENTION

The present invention is thus founded on the basic object of providing an integrated fragment and bullet resistant body armor garment that stably retains body armor material while permitting substantially uninhibited, high-level athletic performance by the wearer. As used herein, the term "athletic" shall mean involving the use of physical skills or capabilities, such as strength, agility, or stamina. Use of the term "athletic" shall not be interpreted to require athletic competition but instead relates to the free, comfortable, and substantially unrestricted movement of the human body in the athletic movements that may be necessary to wearers of body armor, such as military and law enforcement personnel.

A related object of the invention is to provide a fragment and bullet resistant body armor garment that permits confidence in a wearer that the body armor garment will not only provide reliable and effective protection against impacts but that will also not limit the wearer's natural human performance, including during hostile encounters.

Another object of embodiments of the invention is to provide a fragment and bullet resistant body armor garment that has optimal comfort and mobility thereby to be usable and used in everyday life, particularly since military and law enforcement users are unlikely to be able to predict with accuracy which day will be the day that the body armor will be called on to perform its intended purpose.

A further object of the invention, in particular embodiments, is to provide a fragment and bullet resistant body armor garment, such as a sartorially flexible body armor architecture, that can be adjusted and tailored in fit to different body types and mission needs.

A related object of embodiments of the invention is to provide a fully integrated body armor system within an upper body garment, such as a shirt, that eliminates the need for existing modular panels and that can stretch and adjust to fit different body sizes.

Yet another object of embodiments of the invention is to provide a fragment and bullet resistant body armor garment that can be donned and doffed in minimal steps, much like a traditional, unarmored garment.

These and further objects and advantages of the present invention will become obvious not only to one who reviews the present specification and drawings but also to those who have an opportunity to experience an embodiment of an integrated body armor garment as disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the objects of the invention, one embodiment of the integrated body armor garment for providing protection to a wearer against ballistic impacts can comprise a body portion for overlying one or more body parts of the wearer. At least a portion of the body portion can have an outer shell and an underlayer. An armor system of ballistic resistant or anti-ballistic material can be embedded within the body portion between the outer shell and the underlayer.

While the integrated body armor garment could vary in application, it is contemplated that the integrated body armor garment could take the form of an upper body garment with a torso portion and left and right arm sleeves. Under such constructions, at least one finger aperture can be disposed adjacent to a distal end of each of the left and right arm sleeves. With that, a wearer can insert one or more fingers through the finger apertures to permit an application of a longitudinal force on the left and right arm sleeves.

Where the integrated body armor garment takes the form of an upper body garment, the armor system can be an upper torso armor system and can be formed with a plurality of body armor panels. At least some of the plurality of body armor panels can overlap, potentially in a reverse shingle configuration. In one example of the body armor garment, the upper torso armor system can have at least one chest armor panel, at least one upper back armor panel, and a plurality of panels disposed to span deltoid and upper arm portions of the garment. The at least one chest armor panel and the at least one upper back armor panel could be joined to form an upper torso armor panel. Moreover, the plurality of panels disposed to span deltoid and upper arm portions of the garment can be overlapped in a reverse shingle configuration to facilitate the safe absorption or deflection of incident ballistic projectiles.

The plurality of body armor panels can in certain embodiments be connected by a network. The network could be resilient, such as by being formed with a resilient cord or cords that can be threadedly engaged with each of the plurality of body armor panels, such as by being threaded through loops connected to the body armor panels. With that, the network can be adjustable, such as by a cinching of the resilient cord, to permit the plurality of body armor panels to be adjusted in relative position. Where a resilient cord is used, the network can be an elastic suspension network.

In certain embodiments, at least some of the body armor panels could be formed with a plurality of layers of para-aramid synthetic fiber fabric. The layers of para-aramid synthetic fiber fabric could be encapsulated by layers of waterproof material. Alternatively or additionally, body armor panels could be partially or entirely formed by Ultra High Molecular Weight Polyethylene (UHMWPE) materials from suppliers including Honeywell International, Inc. of Morristown, N.J., USA (Honeywell) and DSM Dyneema, LLC of Stanley, N.C. For instance, a flexible ballistic composite made from layers of unidirectional fibers held in place by flexible resins, such as that sold by Honeywell under the trademark Spectra Shield™, could form all or part of one or more body armor panels. Where multiple layers of material are exploited, the layers can be joined to cause at least one edge of at least two adjacent body panels to be disposed in a wedge-shaped configuration to facilitate relative sliding of the body armor panels.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

As is the case with many inventions, the present invention for an integrated body armor garment is subject to a wide variety of embodiments. However, to ensure that one skilled in the art will fully understand and, in appropriate cases, be able to practice the present invention, certain preferred embodiments of the broader invention revealed herein are described below and shown in the accompanying drawings.

Figure 1:
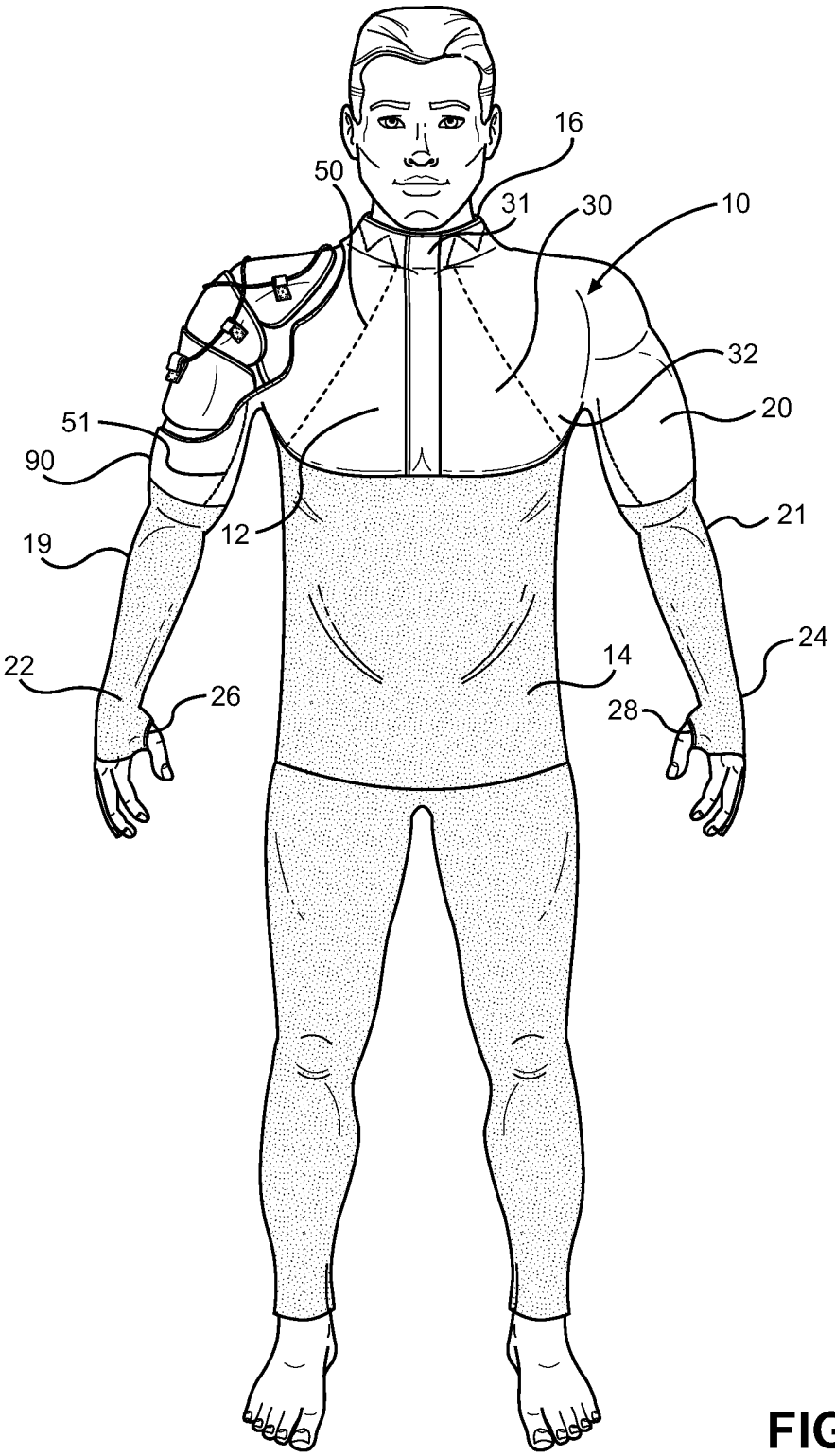
FIG. 1 is a perspective view of an integrated body armor garment according to the invention being worn.

With this in mind and looking more particularly to the accompanying figures, one potential embodiment of the present invention for an integrated body armor garment is indicated generally at 10 in FIG. 1. There, one sees that the integrated body armor garment 10 has a body portion 12 for overlying one or more body parts of a wearer. In this case, the integrated body armor garment 10 takes the form of an upper body covering, such as a shirt, and the body portion 12 comprises a portion for encasing the wearer's chest and upper back. A collar 16 rises from the upper body portion 12, and a torso portion 14 depends from the upper body portion 12. A right arm sleeve 18 projects from a first or right side of the upper body portion 12, and a left arm sleeve 20 projects from a second or left side of the upper body portion 12.

The right arm sleeve 18 terminates in a right cuff 22 that extends to cover the wearer's right wrist and a proximal portion of the wearer's right hand, and the left arm sleeve 20 terminates in an extended left cuff 24 that extends to cover the wearer's left wrist and a proximal portion of the wearer's left hand. As shown, for example, in FIG. 1, the extended cuff 22 includes a thumbhole 26, and the extended cuff 24 includes a thumbhole 28. The thumbholes 26 and 28 are thus retained by the respective arm sleeves 18 and 20 of the integrated body armor garment 10. Under this construction, the integrated body armor garment 10 encapsulates substantially the entirety of the wearer's torso, neck, arms, wrists, and a portion of the hands as FIG. 1 illustrates most clearly.

Advantageously, the construction of the right and left thumbholes 26 and 28 allows the wearer use of his or her hands. Simultaneously, the wearer's inserted thumbs are positioned to exert a longitudinal force on the respective sleeve 18 or 20. With the thumbs exhibiting an extending force on the respective sleeves 18 and 20, the integrated body armor garment 10 tends to be automatically and, if necessary, selectively positioned in a preferred and centered disposition relative to the wearer's body. By further reference to FIG. 1, one sees that, while permitting the wearer's thumbs to exert a longitudinal force capable of pulling distally on the sleeves 18 and 20 of the integrated body armor garment 10, the first and second sleeve cuffs 22 and 24 nonetheless allow the wearer full mobility and dexterity of his or her hands.

In one potential alternative construction, which is not particularly shown, the cuffs 22 and 24 of the left and right sleeves 18 and 20 could alternatively or additionally be lined with or could otherwise retain a grip material, such as a grip elastic or a tunneled elastic, at the distal end of the respective sleeve 18 or 20 to permit an exertion of longitudinal force for positioning the sleeves 18 and 20 and the overall body armor garment 10 in a preferred position on the body.

With additional reference to FIGS. 2 through 4, 9, and 10, the integrated body armor garment 10 can be seen to be formed with multiple materials and layers of material that provide ballistic protection to the wearer while permitting the athletic performance required by military and law enforcement personnel. As described further hereinbelow, the components, layers, and layer and component characteristics of the integrated body armor garment 10 vary over its construction to provide comfortable, flexible, body armor protection to the wearer. It will thus be appreciated that portions of the body armor garment 10 could be formed with just a single layer of material, which could provide ballistic protection or that could merely provide body covering to the wearer.

An upper torso armor system is embedded within the integrated body armor garment 10. As seen, for instance, in FIGS. 7 through 9, the upper torso armor system is formed from a plurality of body armor panels 60, 62, 64, and 70. Here, the armor panels 60, 62, 64, and 70 are disposed to provide substantially continuous protection to the wearer over the chest, upper back, and upper arms. It will be clear that, as used herein, the panels 60, 62, 64, and 70 need not be flat and instead will likely be contoured. While the panels 60, 62, 64, and 70 could be rigid, the panels 60, 62, 64, and 70 shown and described herein can be soft and flexible to permit the garment 10 to be comfortably worn and to permit a person's substantially unhindered movement while wearing the garment 10.

More particularly, panel 70 comprises an upper torso panel 70 with a rear portion for overlying the wearer's upper back, left and right chest portions for overlying the wearer's left and right pectoral areas, and left and right joining portions that bridge between the rear portion and the left and right chest portions. The chest portions in this example span from the center of the chest to adjacent to or within the underarm area of the garment 10. The chest portions can be joined in a continuous fashion, overlapping, or marginally spaced to permit flexibility within the garment 10 and, where applicable, the passage of a zipper 31 between the chest portions. The rear portion is this embodiment spans continuously across the back portion of the garment from adjacent to the left arm sleeve 18 to adjacent to the right arm sleeve 20. The joining portions narrow relative to the chest and rear portions and travel immediately adjacent to the neck portion of the garment 10 whereby outer trapezius and deltoid portions of the upper torso panel 70 are left open.

Figure 8:
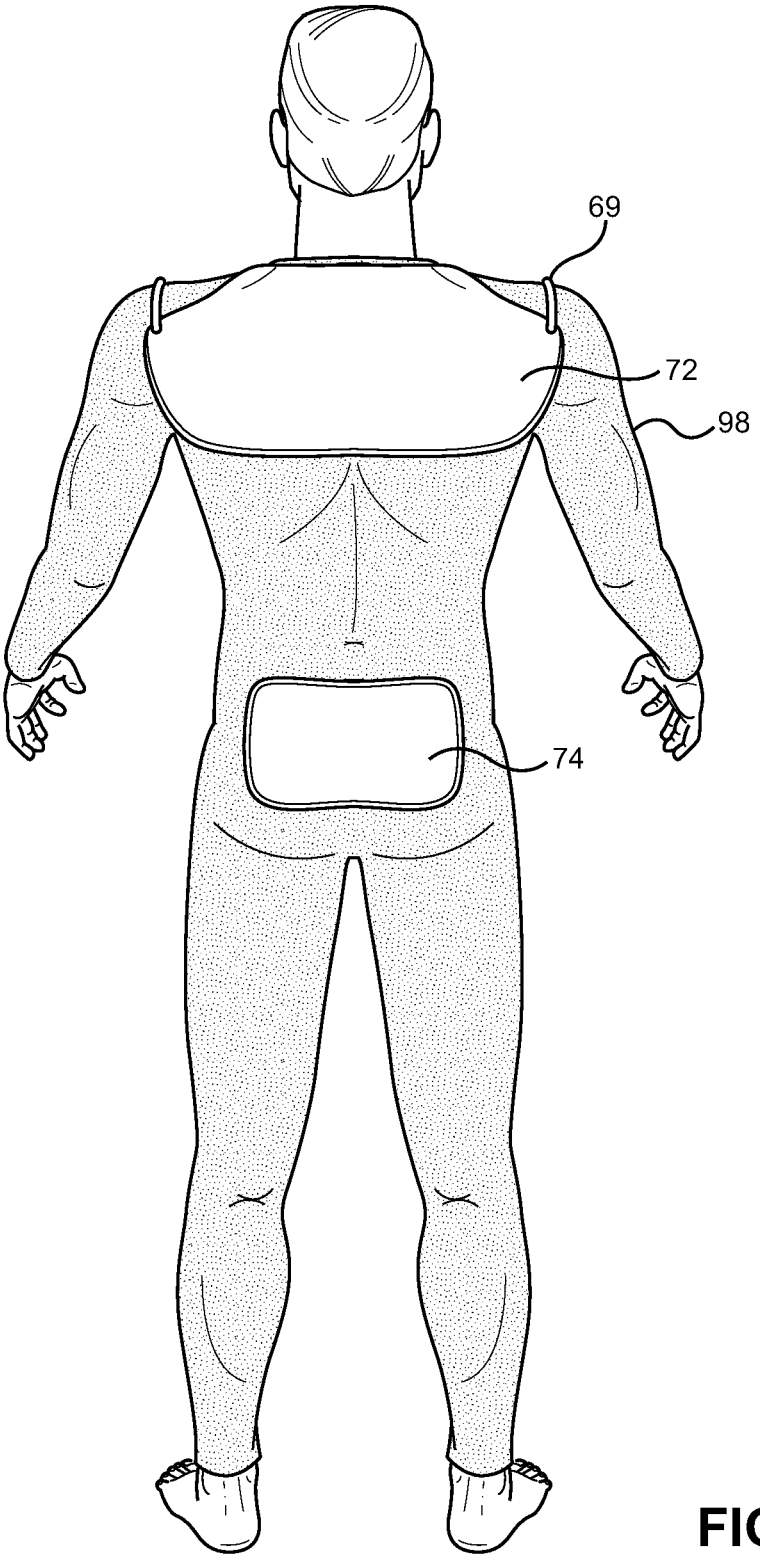
FIG. 8 is a view in rear elevation of the integrated body armor garment with the outer shell and the shoulder and upper arm body armor panels removed to depict the underlying portions of the integrated soft body armor panel system.

Distal or outboard portions of the chest and rear portions of the upper torso panel 70 can be supported by the enveloping layers of the garment 10 and, additionally or alternatively, by a suspension system as indicated at 69 in FIG. 8. The suspension system 69 could be an elastic suspension network, such as a network formed by one or a plurality of elastic connectors. Here, the outboard portions of the chest and rear portions of the upper torso panel 70 are resiliently connected and supported by the suspension system or network 69 as first and second elastic bands, one to the left side of the upper torso panel 70 and one to the right side of the upper torso panel 70. Each band of the network 69 has a first end connected to the chest portion and a second end connected to the rear portion of the upper torso panel 70.

The upper torso armor system protects the outer trapezius and deltoid portions of the garment 10 and the wearer by a series of contoured body armor panels 60, 62, and 64. Together, the body armor panels 60, 62, and 64 span the outer trapezius, deltoid, and upper arm portions of the garment 10 to provide ballistic protection to the underlying and corresponding body portions of the wearer. The body armor panel 60, which may be referred to as a trapezius panel 60, is proximally disposed to overlie the trapezius of the wearer. The body armor panel 62, which may be referred to as a deltoid panel 62, is disposed distal to the trapezius panel 60 to overlie the deltoid of the wearer, and the body armor panel 64, which may be referred to as an upper arm panel 64, is disposed distal to the deltoid panel 62 to overlie the upper arm of the wearer. The body armor panels 60, 62, 64, 70 can be contoured corresponding to the typical or specific contour of the corresponding body portions of the wearer. It will be recognized, of course, that further or fewer panels 60, 62, 64, and 70 could be employed within the scope of the invention.

Figure 9:
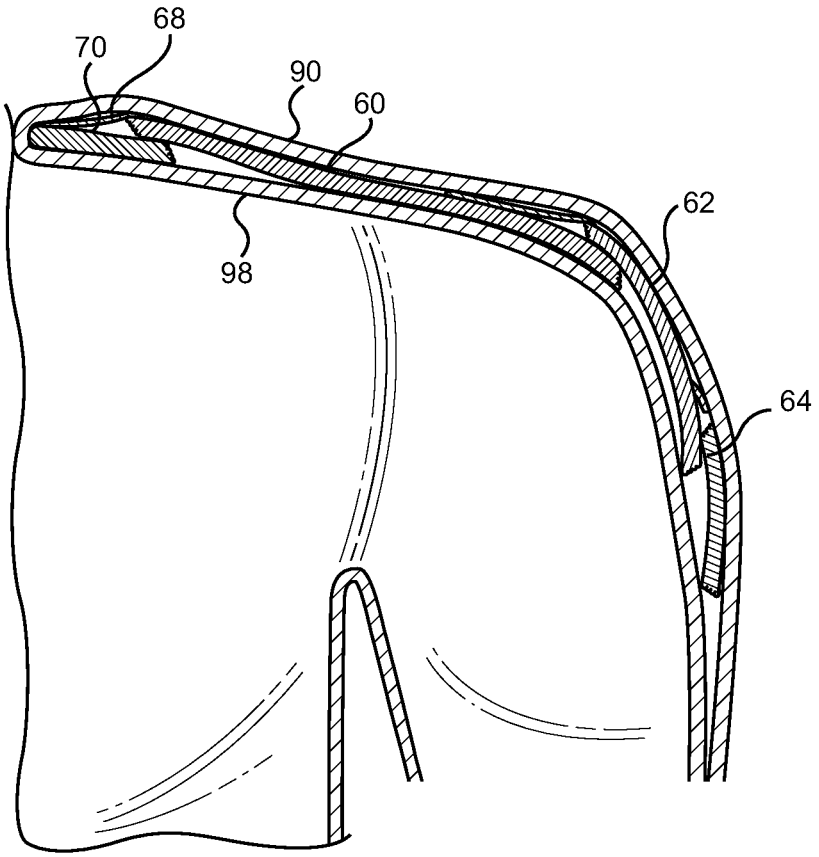
FIG. 9 is a cross-sectional view of the upper torso portion of the integrated body armor garment of FIG. 7.
Figure 10:
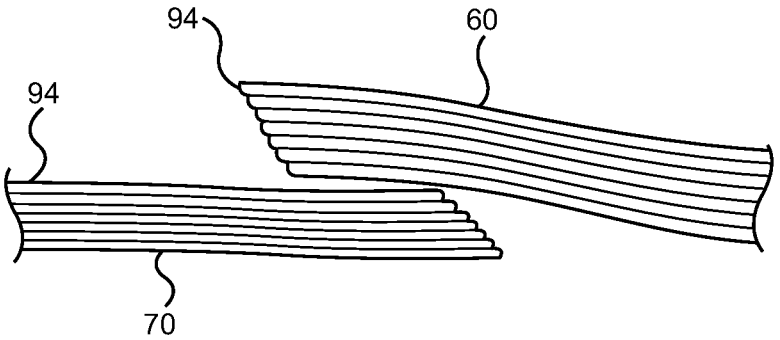
FIG. 10 is a cross-sectional view of adjacent body armor panels.

As seen in FIGS. 9 and 10, the armor panels 60, 62, 64, 70 can overlap, such as in a shingle overlap configuration. In this manifestation of the garment 10, the armor panels 60, 62, 64, 70 overlap in what may be referred to as a reverse shingle overlap configuration under which lower or distal panels have proximal portions overlying distal portions of upper or proximal panels. As such, the proximal portion of the body armor panel 64 overlies the distal portion of the body armor panel 62, and the proximal portion of the body armor panel 62 overlies the distal portion of the body armor panel 60. The armor panels 60 and 62 and potentially the panel 64 have edge portions that overlap the upper torso panel 70. With the armor panels 60, 62, 64, and 70 disposed in the described and depicted reverse shingle overlap configuration, ballistic impacts on a panel or panels 60, 62, and 64 from below or adjacent to the wearer will end to be absorbed and deflected by the panels 60, 62, and 64 rather than immediately lifting one panel 60, 62, or 64 or another to reach the wearer.

While permitting such movement and flexibility, the soft body armor panels 60, 62, 64, and 70 are patterned and shaped to maintain maximum areas of ballistic protection when the integrated body armor garment 10 and the wearer are in motion. In embodiments of the invention, the body armor panels 60, 62, 64, and 70, which can be soft and flexible, are cut and configured to provide an overlap, such as but not limited to an overlap of approximately one inch between adjacent panels 60, 62, 64, and 70. The overlap between adjacent soft body armor panels 60, 62, 64, and 70 is configured to allow each panel 60, 62, 64, and 70 to slide, such as when the elastic suspension networks 68 and 69 are stretched. The overlapping construction also tends to maintain maximum ballistic coverage while preventing any potential gap areas between panels 60, 62, 64, and 70 when the elastic suspension networks 68 and 69 are stretched as during movement of the wearer's body.

The reverse shingle construction thus seeks to resolve the dichotomous challenges of providing ballistic coverage while permitting substantially unrestricted movement at the upper arm and shoulder. Considering, for example, a soldier throwing a grenade, it will be understood that compound movements of the upper arm and shoulder require specific engineering of the garment 10 to allow for maximum ballistic coverage while permitting substantially unrestricted movement at, for example, the ball and socket joint of the arm. As the wearer raises his or her arm, each separate soft body armor panel 60, 62, and 64 is able to move, slide, and increasingly or decreasingly overlap each adjacent panel 60, 62, and 64 by virtue of the reverse shingle construction where the upper arm panel 64 overlies the deltoid panel 62 and the deltoid panel 62 overlies the trapezius panel 60. As discussed elsewhere herein, the soft body armor panels 60, 62, 64, and 70 are mutually retained and supported by the elastic suspension networks 68 and 69 thereby preventing unintended shifting of the panels 60, 62, 64, and 70, including during movement of the wearer, that could then reduce ballistic coverage in vital areas.

Figure 7:
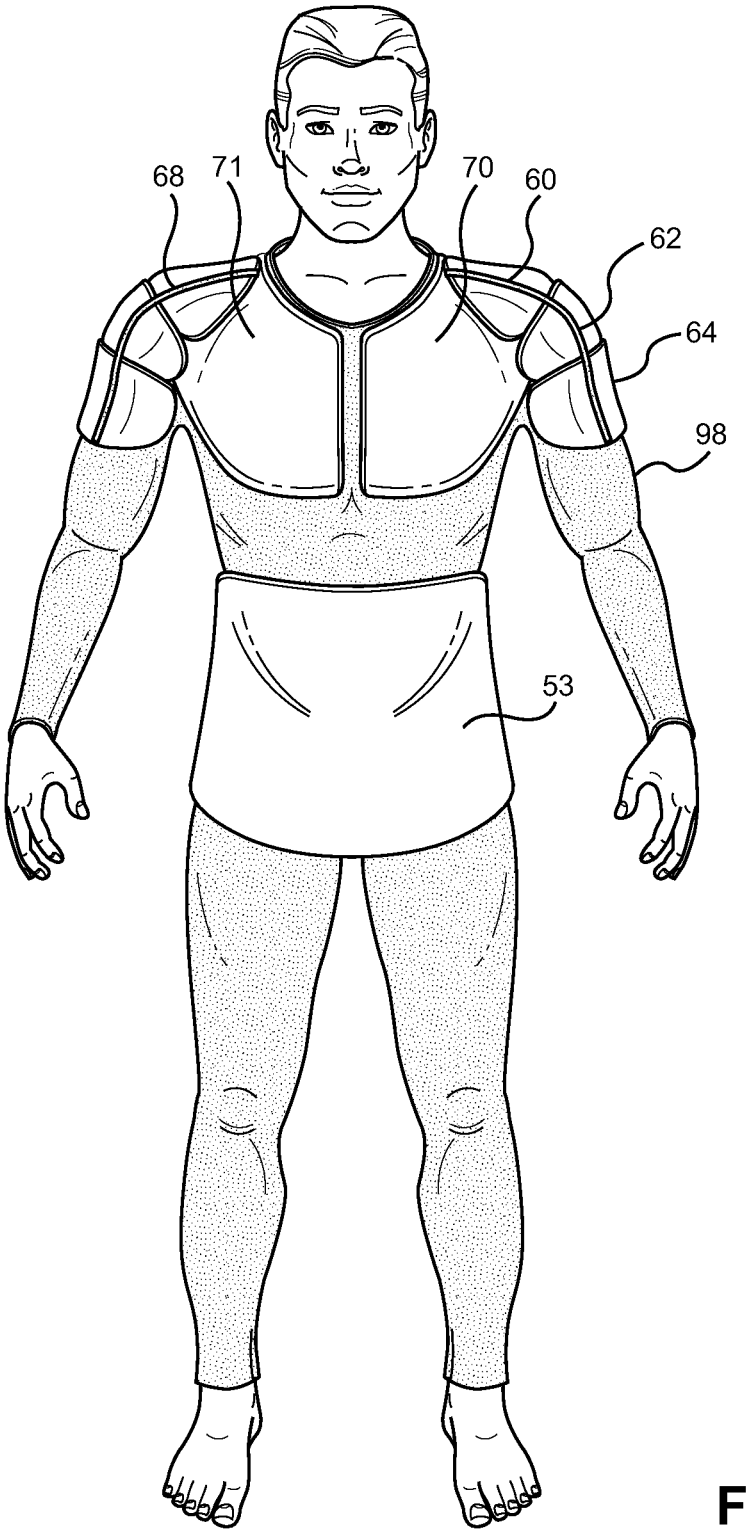
FIG. 7 is a view in front elevation of the integrated body armor garment with an outer shell thereof removed to depict the integrated soft body armor panel system disclosed herein.

Like the upper torso panel 70, the armor panels 60, 62, and 64 can be supported by the enveloping layers of the garment 10 and, additionally or alternatively, by a suspension system or network as indicated at 68 in FIG. 7. The suspension system 68 could be an elastic suspension network, such as a network formed by one or a plurality of elastic connectors. Here, panels 60, 62, and 64 are resiliently connected and supported by the suspension network or system 68 by forward and rearward elastic bands that are fixed to the panels 60, 62, and 64 to traverse longitudinally from panel 60 to panel 62 to panel 64 thereby to create an elastic suspension network 68 for the panels 60, 62, and 64. With the combined effects of the elastic suspension networks, systems, or members 68 and 69, a mutually supporting and stabilizing coupling is established between the body armor panels 60, 62, 64, and 70. Of course, further or differently configured elastic suspension members, bands, systems, or networks 68 and 69 would be readily obvious to one reviewing the present disclosure and are within the scope of the invention.

There are many advantages to having an elastic suspension network or networks 68 and 69 to couple the soft body armor panels 60, 62, 64, and 70 within the integrated body armor garment 10. As one skilled in the art of tailoring can appreciate, attempting to add body armor to a garment necessarily adds additional weight and can lead to uneven distribution of weight in a garment that is meant to conform, stretch, and move with the body. Where weight and distribution of weight caused by the body armor becomes uneven and excessive, the articles can become uncomfortable to the wearer. They can also obstruct the wearer's mobility while weakening the integrity of the garment, including potentially by causing tears to the outer shell surface or tears at the joining seams. The elastic suspension networks or systems 68 and 69 seek to maintain an even and predetermined distribution of the body armor panels 60, 62, 64, and 70 thereby minimizing the deleterious effects of wearing body armor while concomitantly encouraging its use due to the comfort and mobility permitted by use of the integrated body armor garment 10 disclosed herein.

As noted above, the components forming the elastic suspension networks or systems 68 and 69 can vary widely under the invention. In one embodiment, for instance, the elastic suspension network 68 and 69 can be formed from an elastic material, such as narrow woven elastic. The narrow woven elastic in presently contemplated embodiments can be stitched to the outer surface of the body armor panels 60, 62, 64, and 70. The elastic suspension networks 68 and 69 can be formed from individual segments or continuous lengths of elastic material.

The elastic suspension networks 68 and 69 thus establish a mutual coupling of the panels of soft body armor 60, 62, 64, and 70 while permitting stretching and relative movement between the soft body armor panels 60, 62, 64, and 70. It will be appreciated that the stretching and relative movement and the resulting athletic ability permitted by use of the integrated body armor garment 10 can be critical in law enforcement and military applications. For instance, again considering when a soldier throws a grenade, the muscles of the arms and upper back can and must contract and flex quickly to carry out the compound motions involved in throwing the projectile. Therefore, the flexibility of the individual panels 60, 62, 64, and 70 and the relative movement permitted therebetween by virtue of their separate nature and the elastic suspension networks 68 and 69 are highly advantageous in allowing for natural complex movements within the integrated body armor garment 10.

In addition, the elastic suspension networks 68 and 69 mechanically support and distribute the weight of the body armor panels 60, 62, 64, and 70 and the garment 10 in general in a more even manner than if the panels 60, 62, 64, and 70 were allowed to droop and sag within the garment 10, such as due to their differential weight. The added mechanical support for the wearer can assist in alleviating muscular and skeletal discomfort and trauma that can be produced by, among other things, uneven weight on the body and unintended placement of the panels 60, 62, 64, and 70. In other embodiments, although not particularly shown, ballistic panels could be added or removed in the architecture based on the requirements for the garment 10 within the military and law enforcement agencies. The elastic suspension networks 68 and 69 can be modified to couple more panels or fewer panels based on the needs of the wearer.

As FIG. 9 illustrates, the upper torso armor system formed by the armor panels 60, 62, 64, and 70 can be fully encased or enveloped within the garment 10. For instance, the upper torso armor system can be disposed between one or more outer shell layers 90 and one or more base lining layers or underlayers 98. The outermost outer shell layer 90 is exposed to the environment, and the innermost base layer 98 is disposed to contact the wearer or whatever layers, if any, the wearer might choose to wear under the integrated body armor garment 10. Under this construction, the body armor garment 10 and the armor components thereof are fully integrated to form an integrated garment 10. With the single act of putting on the shirt-like integrated body armor garment 10, a wearer is protected by the retained armor panels 60, 62, 64, and 70. With the single act of removing the garment 10 as one would a shirt, the upper torso armor system is removed.

Figure 2:
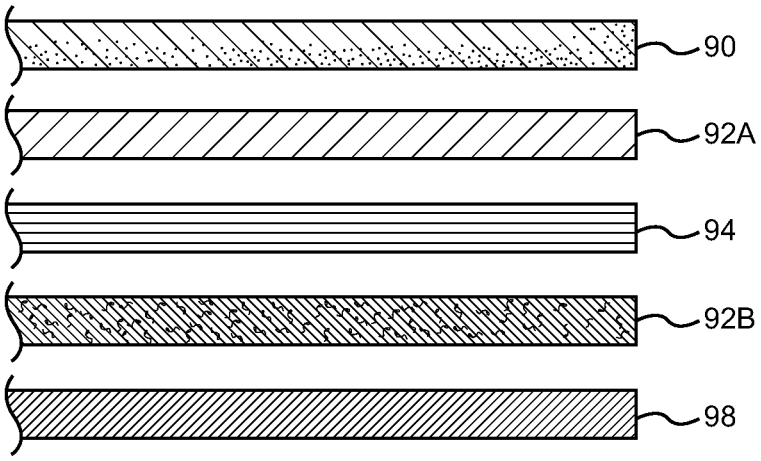
FIG. 2 is a cross-section of the upper torso and upper arm layers of an integrated body armor garment as taught herein.
Figure 3:
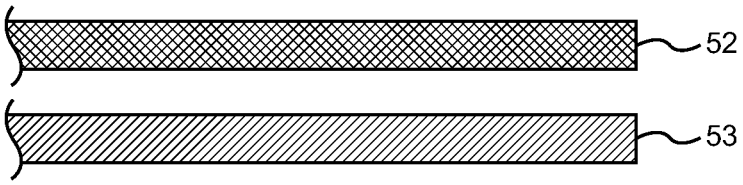
FIG. 3 is a cross-section of the lower front torso layers of an integrated body armor garment pursuant to the invention.

It will thus be appreciated that the upper body portion 12 and the upper portion of the right and left arm sleeves 18 and 20 of the integrated body armor garment 10 comprise a layered system of armored, yet flexible and comfortable, protection. With additional reference to FIG. 2, a cross-section of layers of material that could form the upper body portion 12 and the proximal portions of the arm sleeves 18 and 20 is provided. As noted previously, the upper body portion 12 has an outer shell 90 and an underlying lining or underlayer 98. One or a plurality of body armor panels, such as that indicated generically at 94 in FIG. 2, is interposed and retained between the outer shell 90 and the lining 98. Here, the body armor panel 94 is representative of other panels in the garment 10, such as those indicated at 60, 62, 64, and 70. While the number and arrangement of layers shown and described herein may be preferable, it will be appreciated that the invention should not be so limited, except as may be required by the claims.

As discussed further hereinbelow, the body armor panel 94 could be a flexible panel, such as a panel of one, multiple, or even a large plurality of layers of para-aramid synthetic fiber fabric. Embodiments are contemplated with forty or more layers of ballistic resistant material, such as fabric, which can be para-aramid synthetic fiber fabric. Where multiple layers are exploited, they could simply overlie one another, or they could be joined, secured, bonded, or otherwise coupled. Body armor panels could additionally or alternatively be partially or entirely formed by Ultra High Molecular Weight Polyethylene (UHMWPE) materials from suppliers including Honeywell International, Inc. of Morristown, N.J., USA (Honeywell) and DSM Dyneema, LLC of Stanley, N.C. For instance, a flexible ballistic composite made from layers of unidirectional fibers held in place by flexible resins, such as that sold by Honeywell under the trademark Spectra Shield™, could form all or part of one or more body armor panels.

It is further contemplated that the ballistic body armor panels 60, 62, 64, and 70 forming the resilient network could be tailored, such as with traditional apparel construction techniques, to conform to the geometry of the wearer's body. Similarly conforming or more complex shapes can be produced, for instance, with additional or alternative molding, pressing, or shaping methodology. The construction of the resilient network of ballistic body armor panels 60, 62, 64, and 70 are readily versatile and compatible with traditional and more complex manufacturing techniques.

The lining 98 could, by way of example and not limitation, be a synthetic fibrous fabric chosen for comfort and breathability. Under certain practices of the invention, for instance, the lining 98 can be formed by a spandex knit as is sold under the registered trademark LYCRA by Invista North America S.à r.l. of Wichita, Kans., United States. The lining 98 preferably will have a soft and pliable construction that can thus lie next to the skin of the wearer's body or against one or more sub-layers while providing comfort and stretch for range of motion.

Under certain practices of the invention, some or all of the armor panels, such as those indicated at 60, 62, 64, and 70, retained by or within the garment 10 can be formed as further shown in FIG. 2 where the layers forming the soft body armor panel are again indicated generally at 96. The soft body armor panel 96 is founded on multiple soft and flexible body armor layers 94 formed of para-aramid synthetic fiber fabric, such as that sold under the registered trademark KEVLAR by E. I. du Pont de Nemours and Company of Wilmington, Del., United States. Again, however, the invention is not so limited as to the particular anti-ballistic material forming the body armor panel 96. By way of example and not limitation, body armor panels could be partially or entirely formed by Ultra High Molecular Weight Polyethylene (UHMWPE) materials from suppliers including Honeywell International, Inc. of Morristown, N.J., USA (Honeywell) and DSM Dyneema, LLC of Stanley, N.C. More particularly, a flexible ballistic composite can be employed as made from layers of unidirectional fibers that are held in place by flexible resins, such as that sold by Honeywell under the trademark Spectra Shield™.

Upper and lower layers 92A and 92B of material are disposed to partially or completely encapsulate the several body armor layers 94. The upper and lower layers 92A and 92B in this preferred embodiment comprise a waterproofed nylon woven material that fully encapsulates the multiple soft body armor layers 94 of para-aramid synthetic fiber fabric, Ultra High Molecular Weight Polyethylene (UHMWPE), or other anti-ballistic armor material. The upper and lower surface layers 92A and 92B of the soft body armor panel 96 can have fully waterproofed surfaces and can be constructed so the joining seams are fully waterproofed to maintain the integrity of the soft body armor layers 94.

The outer shell 90 can be formed from a material demonstrating abrasion and knife resistance. In one practice of the invention, the outer shell 90 is formed from a semi-stretch, three-dimensional polymeric surface material.

The portions of the integrated body armor garment 10 other than the above-described upper torso armor system could in theory be similarly configured, or they could be configured as with a traditional garment, potentially with just a single layer of ballistic or non-ballistic material as is illustrated, for example, in FIG. 9, or with some other level or type of protection for the wearer. For instance and looking more particularly to FIG. 3, a cross section is provided of a lower front or abdomen portion of the integrated body armor garment 10. Here, there is a localized layered system that is formed by an outer shell 52 that overlies an underlayer 53. The outer shell surface 52 could, for example, be formed by a knit mesh construction to minimize bulk and weight for the garment 10 while providing airflow for increased breathability. The underlayer 53 can, for example, comprise one or more layers of para-aramid synthetic fiber fabric, Ultra High Molecular Weight Polyethylene (UHMWPE), or other anti-ballistic armor material. By way of example and not limitation, knitted para-aramid synthetic fiber fabric can be considered advantageous in that it provides ballistic protection in a lightweight stretch material suitable for the abdominal region. Although not specifically shown, it is alternatively or additionally possible for more breathability and airflow to be provided within and through the garment 10 by eliminating the ballistic protection layer or layers at the abdomen in favor of just one layer of knit mesh as an outer shell surface 52.

Figure 4:
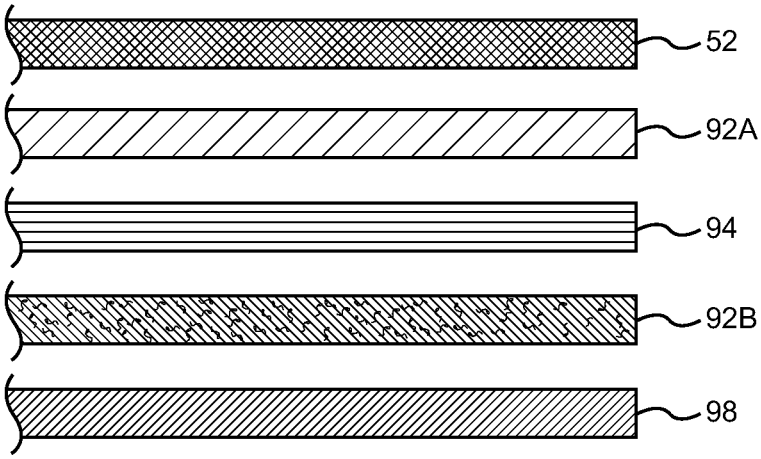
FIG. 4 is a cross-section of the lower back torso layers of an integrated body armor garment according to the invention.

Other portions of the integrated body armor garment 10 could have soft body armor panels that may or may not be disposed in contiguous, spaced, or overlapping fashion. For instance, some or all of the lower back of the torso portion 14 could be configured with a lower back panel 74 as seen in FIG. 8, and the lower back panel 74 can have a cross-sectional configuration as illustrated in FIG. 4. There, the localized layered system of the lower back panel 74 is shown to be formed by an outer shell 52 that overlies a soft body armor panel 96, which could be constructed as previously described, and is lined with an inner lining layer 98. The lining layer 98 again could comprise a knit, such as a polymeric knit, with a soft and pliable construction that can lie next to the skin of the body or against a sub-layer of material while providing comfort and stretch capabilities for range of motion. As before, upper and lower layers 92A and 92B of material are disposed to partially or completely encapsulate the several body armor layers 94. The upper and lower layers 92A and 92B could again comprise a waterproofed nylon woven material that fully encapsulates the multiple soft body armor layers 94 of para-aramid synthetic fiber fabric, Ultra High Molecular Weight Polyethylene (UHMWPE), or other anti-ballistic armor material. The upper and lower surface layers 92A and 92B can be waterproof and, as applicable, can be constructed so the joining seams are fully waterproof to maintain the integrity of the fibers of the soft body armor layers 94. Here, the outer shell 52 can be formed to minimize bulk and weight for the garment 10 while providing airflow for increased breathability. While the particular materials could vary, one embodiment could be crafted with a knit mesh construction forming the outer shell 52. Nonetheless, it is again noted that breathability and airflow within the garment 10 could be provided, although at a loss of some protection, by eliminating the lower back ballistic protection in favor of just one layer of knit mesh or another material.

As shown, for instance, in FIG. 10 relative to the upper torso panel 70 and the deltoid panel 60, the soft body armor layers 94 forming the panels 60, 62, 64, and 70 can be multiple, potentially forty or more. The layers 94 can be multiple, cut layers 94 that are graduated in dimensional size in successive order. This graduation in size tends to smooth the edges of the panels 60, 62, 64, and 70 and to cause the edges thereof to pursue an angled or wedge-shaped configuration. The wedge-shaped configuration tends to minimize material bulk at the overlapping portions of the panels 60, 62, 64, and 50 and to reduce the potential for the relative sliding motion of the shingles formed by the panels 60, 62, 64, and 70 to become caught and thus to hinder the full range of motion of the garment 10 and the mobility of the wearer.

With further reference to FIG. 1, it can be understood that further ballistic protections can be incorporated elsewhere into the garment 10, such as into the collar portion 16, a zipper placket 30, and the forearm portions 19 and 21 of right and left arm sleeves 18 and 20 respectively. For instance, the collar portion 16 can have a localized layer system substantially corresponding to the localized layered system of FIG. 2 thereby to provide ballistic protection to the wearer's neck and, possibly, the wearer's face.

Figure 13:
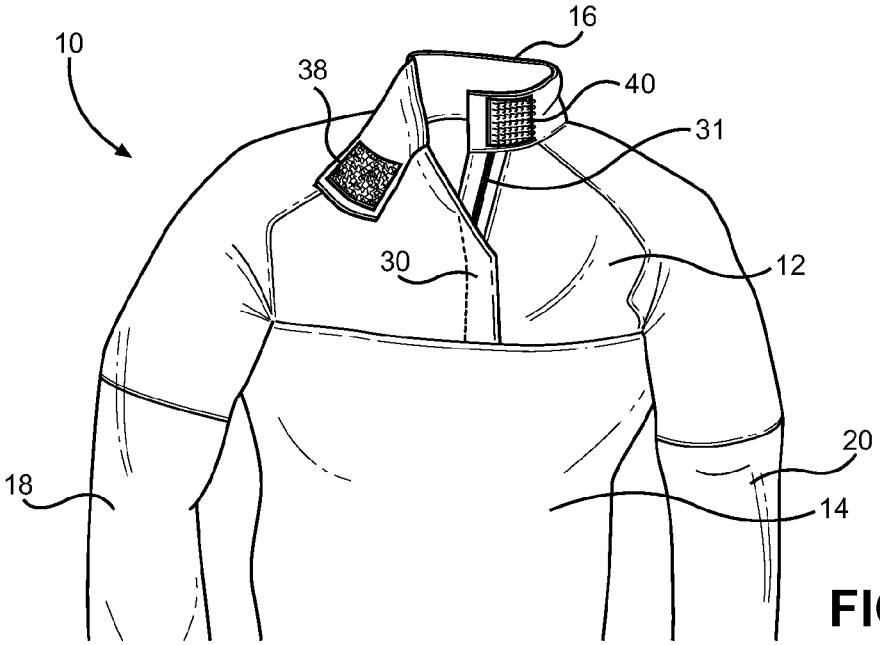
FIG. 13 is a view in front elevation of an embodiment of the integrated body armor garment disclosed herein with an adjustable collar fastening mechanism in an open configuration.
Figure 14:
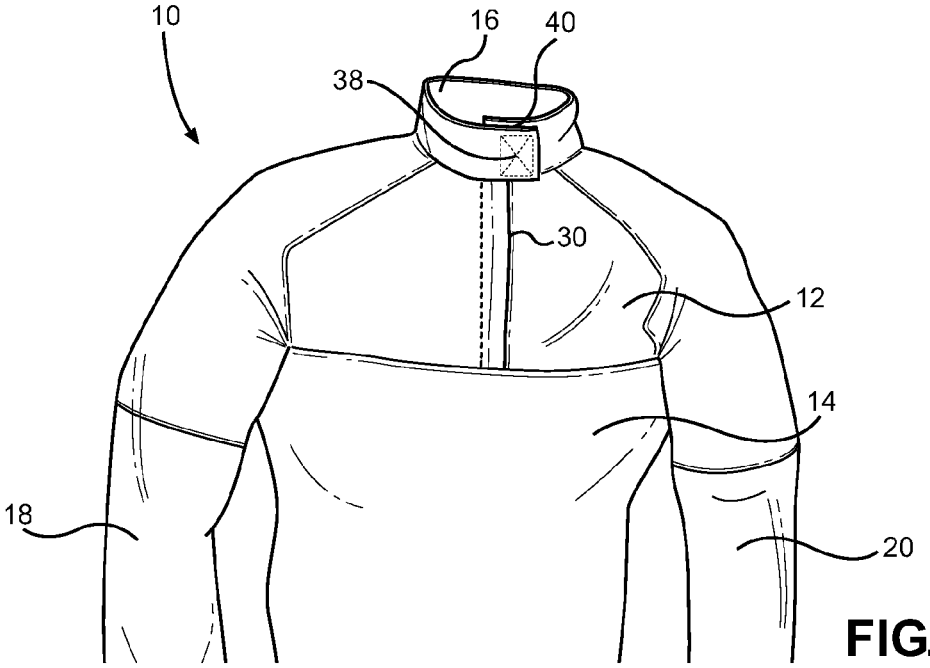
FIG. 14 is a view in front elevation of the integrated body armor garment of FIG. 13 with the adjustable collar fastening mechanism in a closed configuration.

The collar portion 16 can have an adjustable collar fastening mechanism as suggested by FIG. 13, where the collar portion 16 is depicted in an open configuration, and FIG. 14, where the collar portion 16 is depicted in a closed configuration. While the adjustable collar fastening mechanism could vary within the scope of the invention, the depicted fastening mechanism comprises a section of hook or loop material 38 disposed adjacent to one end of the collar portion 16 and a section of loop or hook material 40 disposed adjacent to the other end of the collar portion 16. The hook and loop material sections 38 and 40 or similar sections can span some or the entire length of the placket 30 overlying the zipper 31.

Under this construction, the collar portion 16 can be selectively retained in an overlapping manner as depicted in FIG. 14, and the effective circumference established by the collar portion 16 can be varied to suit the physical characteristics and comfort of the wearer. When disposed in an overlapping configuration as in FIG. 14, the collar portion 16, which is formed from or incorporating ballistic protective material, can provide ballistic protection to the neck and adjacent areas of the body of the wearer. Of course, other adjustable fastening mechanisms are possible and within the scope of the invention, including but not limited to buttons, clasps, adhesive, zippers, or any other effective fastening mechanism.

Where the integrated body armor garment 10 has a zipper 31, the placket 30 can overlie the zipper 31, and the placket 30 can have a localized layered system again corresponding to that illustrated in FIG. 2 or some other ballistic protection material. As such, a placket 30 so constructed can provide ballistic protection by overlapping the zipper 31 and any gap areas around seams and openings at the zipper 31 by a given distance, such as by approximately one inch or more.

The forearm portions 19 and 21 of the right and left arm sleeves 18 and 20 can be formed with ballistic protection, such as with a one-layer knitted para-aramid synthetic fiber panel, Ultra High Molecular Weight Polyethylene (UHM-WPE), or other anti-ballistic armor material, for ballistic protection while providing abrasion and tear resistance. Another embodiment, which is not shown, could be constructed to permit greater stretch and performance, albeit at the loss of some protection, by eliminating the anti-ballistic material at the forearm portions 19 and 21 in favor of a material with two-way or four-way knit stretch capabilities.

Strategic placement of materials in the integrated body armor garment 10, such as in the configurations described above including in relation to FIGS. 1 through 4, provides enhanced protection against ballistic threats. However, it is also important to note areas of the garment 10 that assist in providing increased range and freedom of motion to permit optimal performance by the wearer. Indeed, while the armored portions of the garment 10 described herein are believed to depart from the prior art substantially, other aspects of the patterning and construction of the integrated body armor garment 10 can incorporate structural details and advantages commonly now seen in athletic performance clothing. For example, the garment 10 can be tailored to have a close fit to follow the contours of the body and to move with the natural movements of the muscles and body. The closer fit will also tend to prevent shifting of the several body armor panels, such as panels 60, 62, 64, and 70, and thus assists in maintaining a preferred coverage area from ballistic threats.

Figure 5:
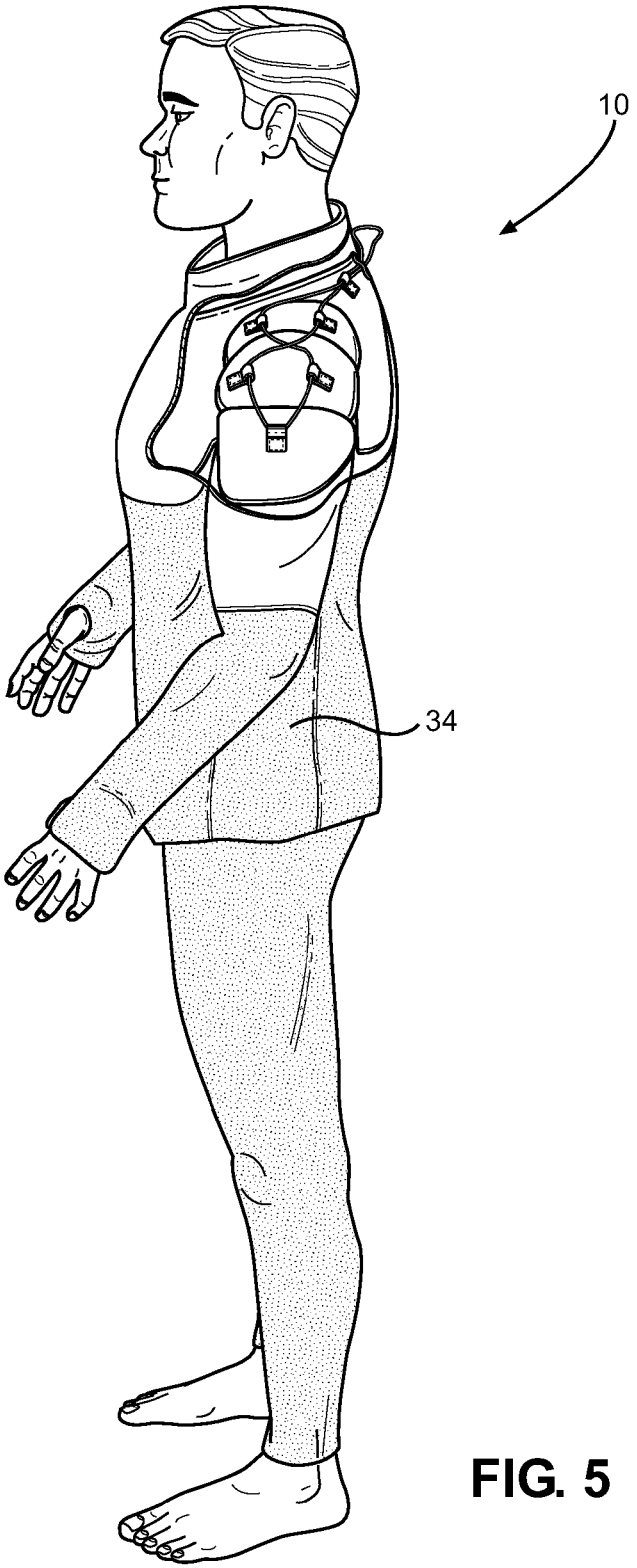
FIG. 5 is a view in side elevation of an integrated body armor garment as taught herein, again being worn.
Figure 6:
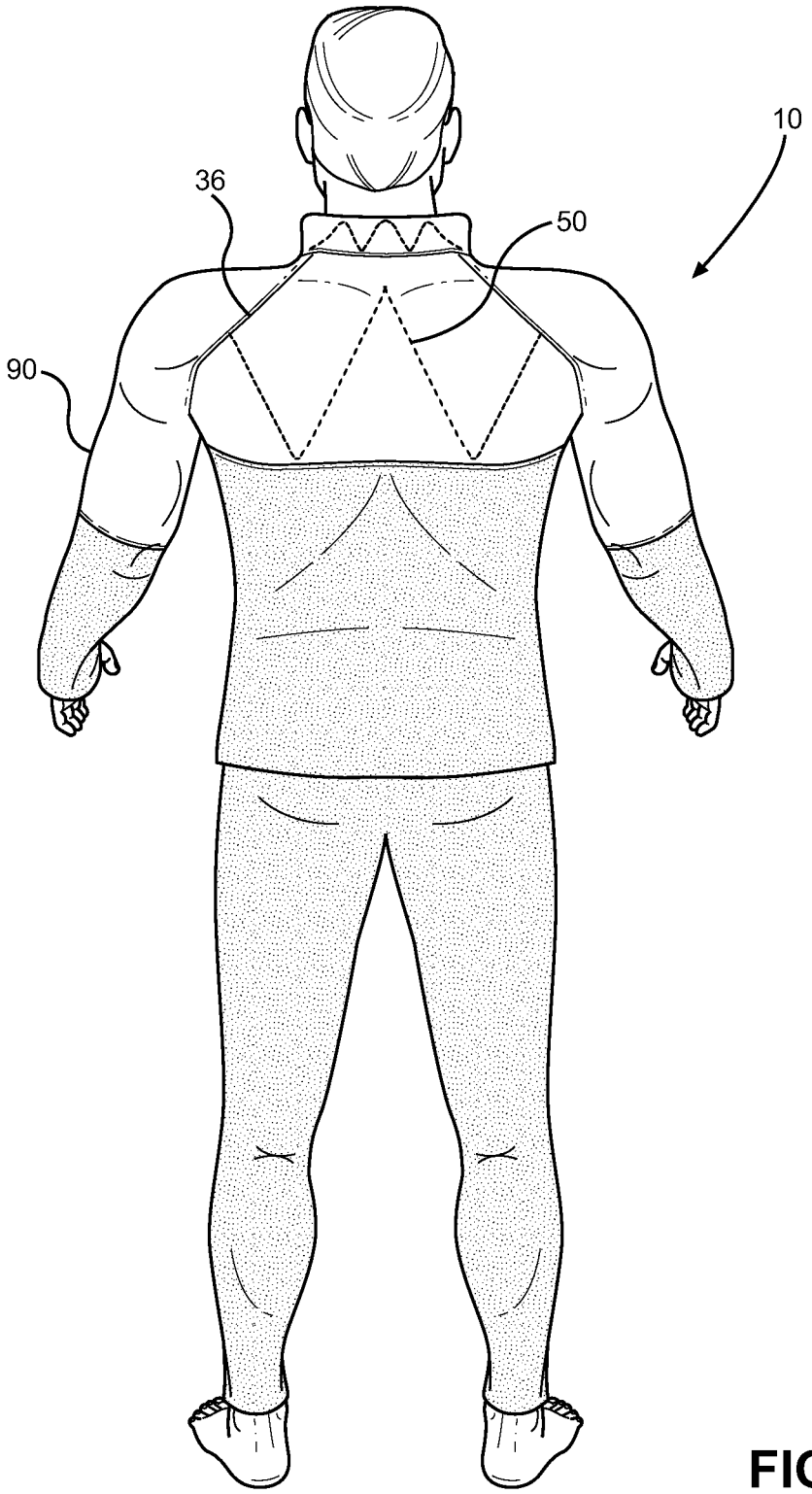
FIG. 6 is a view in rear elevation of an integrated body armor garment according to the invention being worn.

Further enhanced features are incorporated in the patterning and fit of the integrated body armor garment 10 with the goal of increasing the athletic level of performance for the wearer. By way of example, a triangular stretch knit pattern shape at the underarm armhole, called a gusset 32, is used to increase the range of motion of each arm and to prevent potential stress tears at the seams of the sleeves 18 and 20 due to exerted forces of motion by the wearer. Additionally, along the sides of the garment 10 are vertical stretch panels as indicated at 34 in FIG. 5 that provide resilience to permit comfortable movement over a broad range of motion and during donning and doffing the garment 10 over the head and shoulders. Also, one can look further to FIG. 6 where a raglan armhole seam construction 36 can be seen. The seam construction 36 presents a diagonal armhole rather than a circular armhole. The raglan seam construction 36 fits the sleeves 18 and 20 closer to the body and provides an improved range of motion from the arm and extending into the shoulder.

As described and shown herein, therefore, the integrated body armor garment 10 incorporates soft body armor panels, such as those indicated at 60, 62, 64, and 70, and ballistic protection layers that are placed in critical areas to provide protection to the wearer against ballistic and other impacts. The integrated body armor garment 10 can be worn alone, for example, or it could be worn to supplement or address any gap areas of protection for the wearer when worn underneath a separate body armor vest (not shown). As shown in FIG. 7, for example, the trapezius panel 60, the deltoid panel 62, the upper arm panel 64, and the upper torso panel 70 cooperate in an overlapping or in a substantially contiguous relationship to protect the wearer's chest, upper back, trapezius, deltoids, and upper arms. Moreover, lower back panel 74 is disposed to protect the lower back and spine. Further areas of ballistic protection could be provided.

Referring again to FIGS. 1 and 2, the integrated body armor garment 10 has a stitching pattern 50, such as a diagonal stitching pattern 50, to assist in securing the multiple layers and to prevent a relative shifting of the layers. For instance, the stitching pattern 50 can mechanically couple the outer shell 90 to the soft body armor panels 60, 62, 64, and 70 and the soft body armor panels 60, 62 and 64 to the underlayer 98. This stitching pattern 50 can traverse, potentially among other places, all areas where the outer shell 90 overlies separate soft body armor panels 60, 62, 64, and 70. While the stitching pattern 50 in this embodiment communicates diagonally, it is feasible to use many different types of stitching patterns, including but not limited to horizontal, vertical, or even circular patterns, to secure the aligned layers.

As shown in FIG. 1, in areas where movement by the wearer is likely to be significant and repetitive, the integrated body armor garment 10 can feature bartacking 51 on the outer shell 90, such as along the longitudinal edges of the separate soft body armor panels 60, 62, and 64. Bartacking 51 secures the apparel layers or seams that would be located in areas of the garment 10 such as the upper arm that would require mechanical reinforcement due to stresses and pulls along the textile from the wearer's movements. The bartacking 51 could, for example, have a one-half inch stitch length with a high stitch-per-inch construction to reinforce potential stress areas on the garment 10 and to assist in preventing the pulling apart of layers or seams.

It will be noted that the human body has large variations in sizing and even within sizes. For example, wearers that wear a size medium can exhibit different shoulder widths, torso lengths, and arm lengths. Consequently, a size medium garment would not fit the same on different soldiers who consider themselves a size medium. A poor fitting body armor garment could put a soldier's life at risk.

Figure 11:
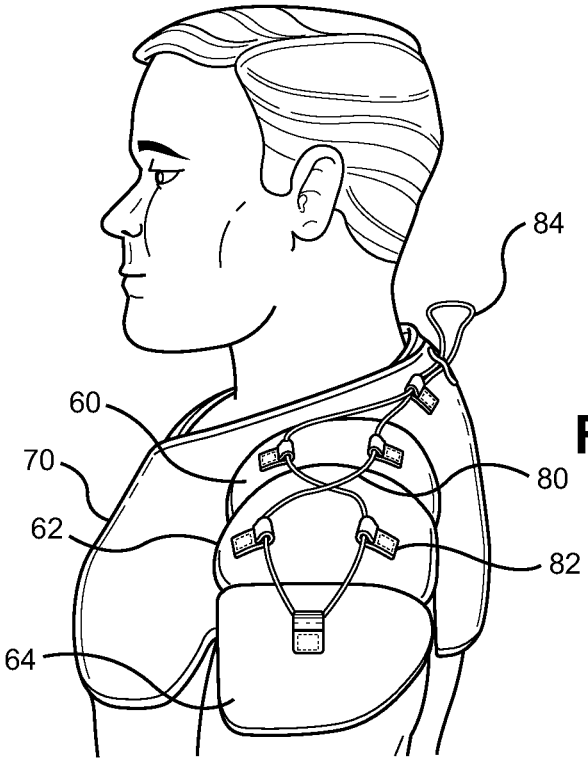
FIG. 11 is a view in side elevation of an embodiment of the integrated body armor garment with an outer shell thereof removed to depict an integrated soft body armor panel system with a unified cinching system as taught herein.
Figure 12:
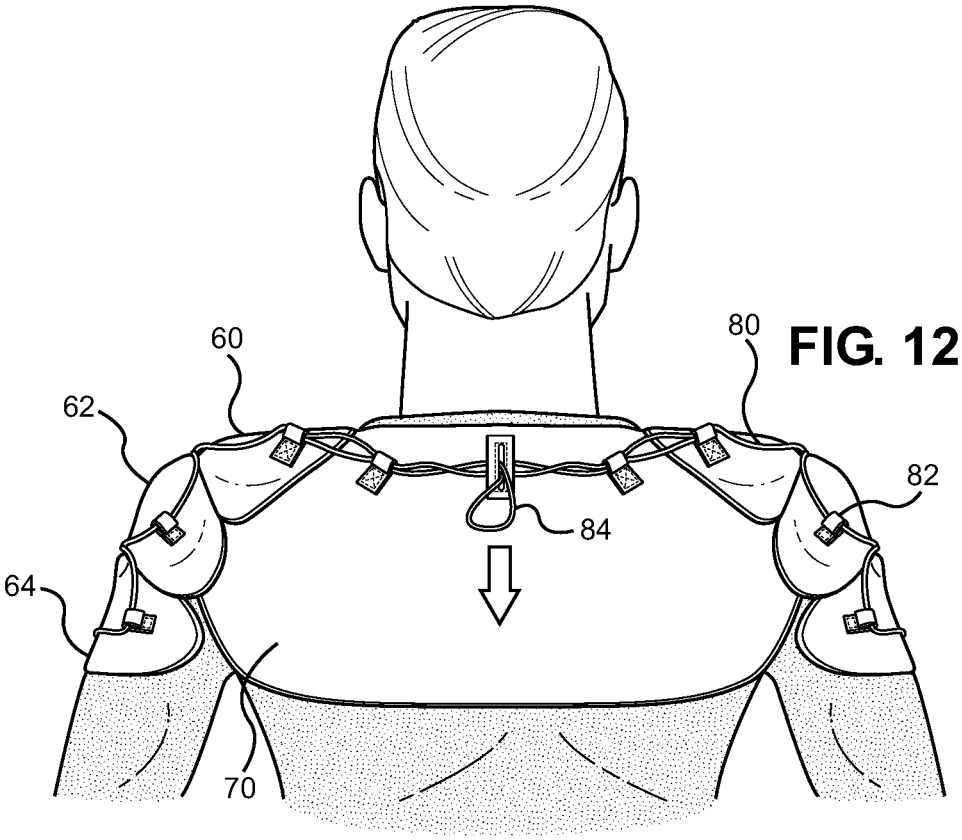
FIG. 12 is a view in rear elevation of the integrated body armor garment, again with the outer shell removed to depict the integrated soft body armor panel system with a unified cinching system as taught herein.

Advantageously, the integrated body armor garment 10 seeks to address the issue of fit and sizing for differently sized individuals. Looking to FIGS. 11 and 12, for instance, a cinching system or network 80 can be disposed to engage the body armor panels 60, 62, 64, and 70, such as by being threadedly engaged with the panels 60, 62, 64, and 70. The cinching network 80 can be adjustable to draw the panels 60, 62, 64, and 70 into and out of proximity with one another. In one example, the cinching network 80 can be formed by one or more cords 80 that can be threaded through sleeves, conduits, layers, loops 82, rings, or any other reception structure retained by or within the panels 60, 62, 64, and 70. For instance, the cord or cords 80 could be an elastic cord 80 that is threadedly engaged with at least one loop 82 or other reception structure on each panel 60, 62, 64, and 70. In the depicted embodiment, by way of example and not limitation, the elastic cord 80 is threaded through plural loops 82 on the trapezius, deltoid, and upper body panels 60, 62, and 70 and at least one loop 82 on the upper arm panel 64. In other embodiments, for example, the cord 80 could be concealed within a tunnel underneath a layer of fabric or other material. In any event, the cord 80 can be configured and retained to effectively span and couple the upper arm, shoulder, and upper back of the panels 60, 62, 64, and 70 of the garment 10.

The elastic cord 80 can be pulled or loosened, such as at the center of the upper back, to assist in customizing the correct fit for each individual within a given size range, such as a size medium. Accordingly, by pulling the elastic cord 80, the reverse shingle body armor panels 60, 62 and 64 can contract or extend relative to one another into the proper position for the wearer's individual body type. The cord 80 can be fixed at a given effective length traversing the body armor panels 60, 62, 64, and 70, such as but not necessarily by a locking mechanism 84, which can be of any effective type, including but not limited to a knot, a toggle closure, a circular dial, an automated or selectively operable motorized or spring-loaded construction, or any other effective mechanism.

With certain exemplary embodiments and details of the present invention for an integrated body armor garment 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. An integrated body armor system for providing protection to a wearer against ballistic impacts, the integrated body armor system comprising:

a plurality of body armor panels, wherein each of the plurality of body armor panels comprises at least one layer of ballistic resistant material and wherein the plurality of body armor panels are connected by a network;

a garment body portion for overlying one or more body parts of a wearer;

wherein the plurality of body armor panels are retained by the garment body portion, wherein the garment body portion comprises an upper body garment with a torso portion and left and right arm sleeves, wherein the plurality of body armor panels comprises an upper torso armor network, wherein the upper torso armor network comprises at least one chest armor panel, at least one upper back armor panel, and a plurality of panels disposed to span deltoid and upper arm portions of the upper body garment, and wherein at least some of the plurality of body armor panels overlap in a shingle configuration.

2. The integrated body armor system of claim 1 wherein the network is resilient.

3. The integrated body armor system of claim 1 wherein the network is adjustable to permit the plurality of body armor panels to be adjusted in relative position.

4. The integrated body armor system of claim 1 wherein the network comprises at least one cord engaged with at least some of the plurality of body armor panels.

5. The integrated body armor system of claim 4 wherein the at least one cord comprises a resilient cord whereby the network comprises an elastic suspension network.

6. The integrated body armor system of claim 5 wherein the at least one cord is threadedly engaged with at least some of the plurality of body armor panels.

7. The integrated body armor system of claim 1 wherein the plurality of panels disposed to span the deltoid and upper arm portions of the upper body garment overlap in a reverse shingle configuration.

8. The integrated body armor garment of claim 1 wherein the network is resilient.

9. The integrated body armor garment of claim 1 wherein the network is adjustable to permit the plurality of body armor panels to be adjusted in relative position.

10. The integrated body armor garment of claim 9 wherein the network comprises at least one cord engaged with at least some of the plurality of body armor panels.

11. The integrated body armor garment of claim 10 wherein the at least one cord comprises a resilient cord whereby the network comprises an elastic suspension network.

12. The integrated body armor garment of claim 10 wherein the at least one cord is threadedly engaged with at least some of the plurality of body armor panels.

13. The integrated body armor garment of claim 1 wherein at least some of the body armor panels are formed from a plurality of layers of para-aramid synthetic fiber fabric.

14. The integrated body armor garment of claim 13 wherein the plurality of layers of para-aramid synthetic fiber fabric are encapsulated by layers of waterproof material.

15. The integrated body armor garment of claim 13 wherein the plurality of layers of para-aramid synthetic fiber fabric are joined to cause at least one edge of at least two adjacent body panels to be disposed in a wedge-shaped configuration.

16. An integrated body armor system for providing protection to a wearer against ballistic impacts, the integrated body armor system comprising:

a plurality of body armor panels, wherein each of the plurality of body armor panels comprises at least one layer of ballistic resistant material and wherein the plurality of body armor panels are connected by a network;

a garment body portion for overlying one or more body parts of a wearer;

wherein the plurality of body armor panels are retained by the garment body portion, wherein the garment body portion comprises an upper body garment with a torso portion and left and right arm sleeves, wherein the plurality of body armor panels comprises an upper torso armor network, and wherein the upper body garment further comprises a collar with at least one layer of ballistic resistant material for providing ballistic protection to a neck of a wearer.

17. The integrated body armor garment of claim 16 further comprising an adjustable collar fastening mechanism for permitting a selective adjustment of an effective circumference of the collar.

18. An integrated body armor garment for providing protection to a wearer against ballistic impacts, the integrated body armor garment comprising:

a garment body portion for overlying one or more body parts of a wearer wherein at least a portion of the garment body portion has an outer shell and an underlayer; and a ballistic armor system embedded within the garment body portion between the outer shell and the underlayer wherein the ballistic armor system comprises at least one layer of ballistic resistant material;

wherein the integrated body armor garment comprises an upper body garment and wherein the garment body portion has a torso portion and left and right arm sleeves; and at least one finger aperture adjacent to a distal end of each of the left and right arm sleeves whereby a wearer can insert one or more fingers through the finger aperture to permit an application of a longitudinal force on the left and right arm sleeves.

19. The integrated body armor garment of claim 18 wherein a portion of the garment body portion of the integrated body armor garment comprises a single layer.

20. The integrated body armor garment of claim 18 wherein the ballistic armor system comprises an upper torso armor system.

21. The integrated body armor garment of claim 18 wherein the upper body garment further comprises a collar with at least one layer of ballistic resistant material for providing ballistic protection to a neck of a wearer.

22. The integrated body armor garment of claim 21 further comprising an adjustable collar fastening mechanism for permitting a selective adjustment of an effective circumference of the collar.

23. The integrated body armor garment of claim 18 wherein the ballistic armor system comprises a plurality of ballistic resistant body armor panels.

24. The integrated body armor garment of claim 23 wherein at least some of the plurality of body armor panels overlap.

25. The integrated body armor garment of claim 23 wherein the plurality of body armor panels are connected by a network.

26. The integrated body armor garment of claim 23 wherein at least some of the plurality of body armor panels overlap in a shingle configuration.

27. The integrated body armor garment of claim 26 wherein the upper torso armor system comprises at least one chest armor panel, at least one upper back armor panel, and a plurality of panels disposed to span deltoid and upper arm portions of the upper body garment.

28. The integrated body armor garment of claim 27 wherein the plurality of panels disposed to span deltoid and upper arm portions of the upper body garment overlap in a reverse shingle configuration.

29. The integrated body armor garment of claim 27 wherein the at least one chest armor panel and the at least one upper back armor panel are joined to form an upper torso armor panel.

30. An integrated body armor garment for providing protection to an upper body of a wearer against ballistic impacts, the integrated body armor garment comprising:

a body portion with a torso portion and left and right arm sleeves; and an upper torso armor system retained by the body portion wherein the upper torso armor system comprises a plurality of ballistic resistant body armor panels, wherein at least some of the plurality of body armor panels overlap in a shingle configuration, and wherein the upper torso armor system comprises at least one chest armor panel, at least one upper back armor panel, and a plurality of panels disposed to span deltoid and upper arm portions of the garment wherein the plurality of panels disposed to span deltoid and upper arm portions of the garment overlap in a shingle configuration.

31. The integrated body armor garment of claim 30 wherein the plurality of body armor panels are connected by a network.

32. The integrated body armor garment of claim 31 wherein the network is resilient.

33. The integrated body armor garment of claim 31 wherein the network is adjustable to permit the plurality of body armor panels to be adjusted in relative position.

34. The integrated body armor garment of claim 33 wherein the network comprises at least one cord engaged with at least some of the plurality of body armor panels.

35. The integrated body armor garment of claim 34 wherein the at least one cord is threadedly engaged with at least some of the plurality of body armor panels.

36. The integrated body armor garment of claim 30 wherein the plurality of panels disposed to span deltoid and upper arm portions of the garment overlap in a reverse shingle configuration.

37. The integrated body armor garment of claim 30 wherein the at least one chest armor panel and the at least one upper back armor panel are joined to form an upper torso armor panel.

38. The integrated body armor garment of claim 30 wherein at least some of the body armor panels are formed from a plurality of layers of para-aramid synthetic fiber fabric.

39. The integrated body armor garment of claim 30 wherein at least a portion of the body portion has an outer shell and an underlayer and wherein the upper torso armor system is embedded within the body portion between the outer shell and the underlayer.

40. The integrated body armor garment of claim 30 further comprising at least one finger aperture adjacent to a distal end of each of the left and right arm sleeves whereby a wearer can insert one or more fingers through the finger aperture to permit an application of a longitudinal force on the left and right arm sleeves.

* * * * *